US012352167B1

(12) United States Patent
Bluth et al.

(10) Patent No.: US 12,352,167 B1
(45) Date of Patent: Jul. 8, 2025

(54) METHOD OF AND SYSTEM FOR IN-SITU CREATION OF CONCRETE ARCHES

(71) Applicant: BluCor Contracting, Inc., Queen Creek, AZ (US)

(72) Inventors: Gordon Antoine Bluth, Mesa, AZ (US); Dustin Bluth, Mesa, AZ (US); Lynden Bluth, Mesa, AZ (US); Tyler Bluth, Mesa, AZ (US); Colton Bluth, Queen Creek, AZ (US)

(73) Assignee: BluCor Contracting, Inc., Queen Creek, AZ (US)

( * ) Notice: Subject to any disclaimer, the term of this patent is extended or adjusted under 35 U.S.C. 154(b) by 0 days.

(21) Appl. No.: 18/977,605

(22) Filed: Dec. 11, 2024

(51) Int. Cl.
*E21D 11/10* (2006.01)
*E03B 3/02* (2006.01)

(52) U.S. Cl.
CPC ..... *E21D 11/105* (2013.01); *E21D 11/102* (2013.01); *E03B 3/02* (2013.01)

(58) Field of Classification Search
CPC ..... B28B 21/06; F16L 1/038; E21D 11/10; E21D 11/102; E21D 11/105
See application file for complete search history.

(56) References Cited

U.S. PATENT DOCUMENTS 1,927,256 A * 9/1933 Copeland ..... E21D 11/102 249/185
2,870,518 A * 1/1959 Bossner ..... E21D 11/102 425/468
2,937,429 A * 5/1960 Livingston ..... B28B 21/06 425/62
3,113,364 A * 12/1963 Blixt ..... F16L 1/038 425/468
3,252,198 A * 5/1966 Fuller ..... F16L 1/038 425/59
3,562,056 A * 2/1971 Olson ..... F16L 1/038 264/32
3,877,855 A * 4/1975 Hanson ..... E21D 11/102 425/64
3,999,908 A * 12/1976 Martin ..... F16L 1/038 425/64
4,001,358 A * 1/1977 McNeill ..... F16L 1/038 264/312
4,017,226 A * 4/1977 Long ..... E21B 43/10 425/64
4,100,751 A * 7/1978 Thomason ..... F16L 1/038 405/155
4,153,398 A * 5/1979 Keller ..... F16L 9/08 425/130
4,407,609 A * 10/1983 Cerutti ..... E21D 11/102 249/11

* cited by examiner

*Primary Examiner* — Benjamin F Fiorello
(74) *Attorney, Agent, or Firm* — Kenneth C. Booth; Booth Udall, PLC

(57) ABSTRACT

A method and structure for forming an elongated concrete arch involving a concrete sled to form a concrete tunnel extending behind the sled as the sled is moved forward. A series of arched forms are placed on the ground within the footprint of the sled, the sled is advanced forward over the arched forms as concrete is poured into a sled through a central passage into a space between the sled and the arched forms. The forms are guided and shaped as they enter the sled. The concrete is smoothed as it extends behind the sled. The arched forms are removed from beneath the concrete arch within 60 minutes of the concrete being poured.

20 Claims, 19 Drawing Sheets

METHOD OF AND SYSTEM FOR IN-SITU CREATION OF CONCRETE ARCHES

TECHNICAL FIELD

This document relates to a method of, and system for, in-situ creation of concrete arches.

BACKGROUND

Stormwater management systems are critical components of urban infrastructure, designed to handle and direct runoff from precipitation to prevent flooding and erosion. One common solution for stormwater drainage is the use of underground stormwater retention systems, which often consist of arch-shaped structures installed under roadways, parking lots, and other surfaces. These arches create voids that facilitate the flow of water while providing structural support to the surface above.

Traditionally, many stormwater retention systems have utilized plastic arches made from high-density polyethylene (HDPE) or similar materials. Plastic arches present several limitations. Over time, plastic can degrade due to exposure to environmental stressors such as ultraviolet (UV) radiation, fluctuating temperatures, and chemical exposure from various pollutants carried by stormwater. Furthermore, plastic arches are susceptible to damage from heavy loads or traffic, which can compromise their structural integrity. In certain conditions, these factors can lead to cracking, warping, or collapse, requiring costly maintenance or replacement.

Another concern is the long-term sustainability and environmental impact of using plastic. While some plastic materials are recyclable, a significant amount still ends up in landfills, contributing to plastic waste and pollution. As urban areas expand and stormwater systems are subjected to increasing demands, the limitations of plastic-based drainage and retention systems become more apparent.

SUMMARY

The present disclosure relates to a method for forming an elongated concrete arch, the method comprising positioning a sled with a flat bottom surface in an initial position on a flat ground surface upon which the elongated concrete arch is to be formed, the sled having a central passage formed as a tunnel extending beneath the sled, positioning a first arched form on the flat ground surface within a footprint of the sled adjacent to an entrance to the central passage of the sled, advancing the sled forward to a first position wherein the first arched form is positioned beneath the sled in the central passage, forming the first arched form into a desired shape with the sled by contacting the first arched form with the sled and forcing the first arched form into the desired shape, wherein forming the first arched form into the desired shape occurs as a result of advancing the sled forward to the first position, pouring concrete into a hopper having a hopper opening on an upper surface of the sled, filling space between the first arched form and the sled with concrete received through the hopper opening to form a first arched section of the elongated concrete arch positioned on the flat ground surface, positioning a second arched form on the flat ground surface within a footprint of the sled adjacent to the entrance to the central passage of the sled, wherein the second arched form is aligned with and adjacent to the first arched form, advancing the sled forward to a second position wherein the second arched form is positioned beneath the sled in the central passage, forming the second arched form into the desired shape with the sled by contacting the second arched form with the sled and forcing the second arched form into the desired shape, wherein forming the second arched form into the desired shape occurs as a result of advancing the sled forward to the second position, filling space between the second arched form and the sled with concrete received through the hopper opening to form a second arched section of the elongated concrete arch positioned on the flat ground surface aligned with and in direct contact with the first arched section, removing the first arched form from the elongated concrete arch within 60 minutes of filling the space between the first arched form and the sled with concrete, and removing the second arched form from the elongated concrete arch within 60 minutes of filling the space between the second arched form and the sled with concrete.

Particular embodiments may comprise one or more of the following features. The concrete poured into the hopper of the sled may have a slump of between 0.5 and 2.0 inches. Advancing the sled forward from the initial position to the first position and from the first position to the second position may occur at a constant rate of at least 4 inches per minute. The elongated concrete arch may be configured to receive stormwater and allow the stormwater to absorb into ground beneath the elongated concrete arch. Filling the space between the first arched form and the sled with concrete and filling the space between the second arched form and the sled with concrete occur while advancing the sled forward from the initial position to the first position and from the first position to the second position.

The present disclosure also relates to a method for forming an elongated concrete arch, the method comprising positioning a sled in an initial position on a flat ground surface upon which the elongated concrete arch is to be formed, the sled having a central passage formed as a tunnel extending beneath the sled, positioning a first form on the flat ground surface within a footprint of the sled adjacent to an entrance to the central passage of the sled, advancing the sled forward to a first position wherein the first form is positioned beneath the sled, forming the first form into an arched shape with the sled, wherein forming the first form into the arched shape occurs as a result of advancing the sled forward to the first position, pouring concrete into the sled, filling space between the first form and the sled with concrete to form a first arched section of the elongated concrete arch positioned on the flat ground surface, positioning a second form on the flat ground surface within a footprint of the sled adjacent to the entrance to the central passage of the sled, wherein the second form is aligned with and adjacent to the first form, advancing the sled forward to a second position wherein the second form is positioned beneath the sled, forming the second form into the arched shape with the sled, wherein forming the second form into the arched shape occurs as a result of advancing the sled forward to the second position, and filling space between the second form and the sled with concrete to form a second arched section of the elongated concrete arch positioned on the flat ground surface aligned with and in direct contact with the first arched section.

Particular embodiments may comprise one or more of the following features. Advancing the sled forward from the initial position to the first position and the second position occurs at a rate of at least 4 inches per minute. The elongated concrete arch may be configured to receive stormwater and allow the stormwater to absorb into ground beneath the elongated concrete arch. Filling the space between the first form and the sled with concrete and filling the space between the second form and the sled with concrete occur while advancing the sled forward from the initial position to the first position and from the first position to the second position. Removing the first form from the elongated concrete arch within 90 minutes of filling the space between the first form and the sled with concrete. The concrete poured into the sled may have a slump of between 0.5 and 2.0 inches. Forming the first form into the desired shape may comprise contacting the first form with the sled and forcing the first form into the desired shape.

The present disclosure also relates to a method for forming an elongated concrete structure, the method comprising positioning a sled in an initial position on a flat ground surface upon which the elongated concrete arch is to be formed, the sled having a central passage formed as a tunnel extending beneath the sled, positioning a first form on the flat ground surface adjacent to an entrance to the central passage of the sled, advancing the sled forward to a first position wherein the first form is positioned beneath the sled, filling space between the first form and the sled with concrete to form a first section of the elongated concrete structure positioned on the flat ground surface, positioning a second form on the flat ground surface adjacent to the entrance to the central passage of the sled, wherein the second form is aligned with and adjacent to the first form, advancing the sled forward to a second position wherein the second form is positioned beneath the sled, and filling space between the second form and the sled with concrete to form a second section of the elongated concrete structure positioned on the flat ground surface aligned with and in direct contact with the first section.

Particular embodiments may comprise one or more of the following features. Forming the first form into a desired shape, wherein forming the first form occurs as a result of advancing the sled forward to the first position. Forming the first form into a desired shape, wherein forming the first form into the desired shape comprises contacting the first form with the sled and forcing the first form into the desired shape. The elongated concrete structure may be configured to receive stormwater and allow the stormwater to absorb into ground beneath the elongated concrete structure. Advancing the sled forward from the initial position to the first position and the second position may occur at a rate of at least 4 inches per minute. Filling the space between the first form and the sled with concrete and filling the space between the second form and the sled with concrete may occur while advancing the sled forward from the initial position to the first position and the second position. Removing the first form from the elongated concrete structure within 90 minutes of filling the space between the first form and the sled with concrete. The concrete poured into the sled may have a slump of between 0.5 and 2.0 inches.

The foregoing and other aspects, features, and advantages will be apparent from the DESCRIPTION and DRAWINGS, and from the CLAIMS if any are included.

BRIEF DESCRIPTION OF THE DRAWINGS

Implementations will hereinafter be described in conjunction with the appended and/or included DRAWINGS, where like designations denote like elements, and.

DETAILED DESCRIPTION

Figure 1:
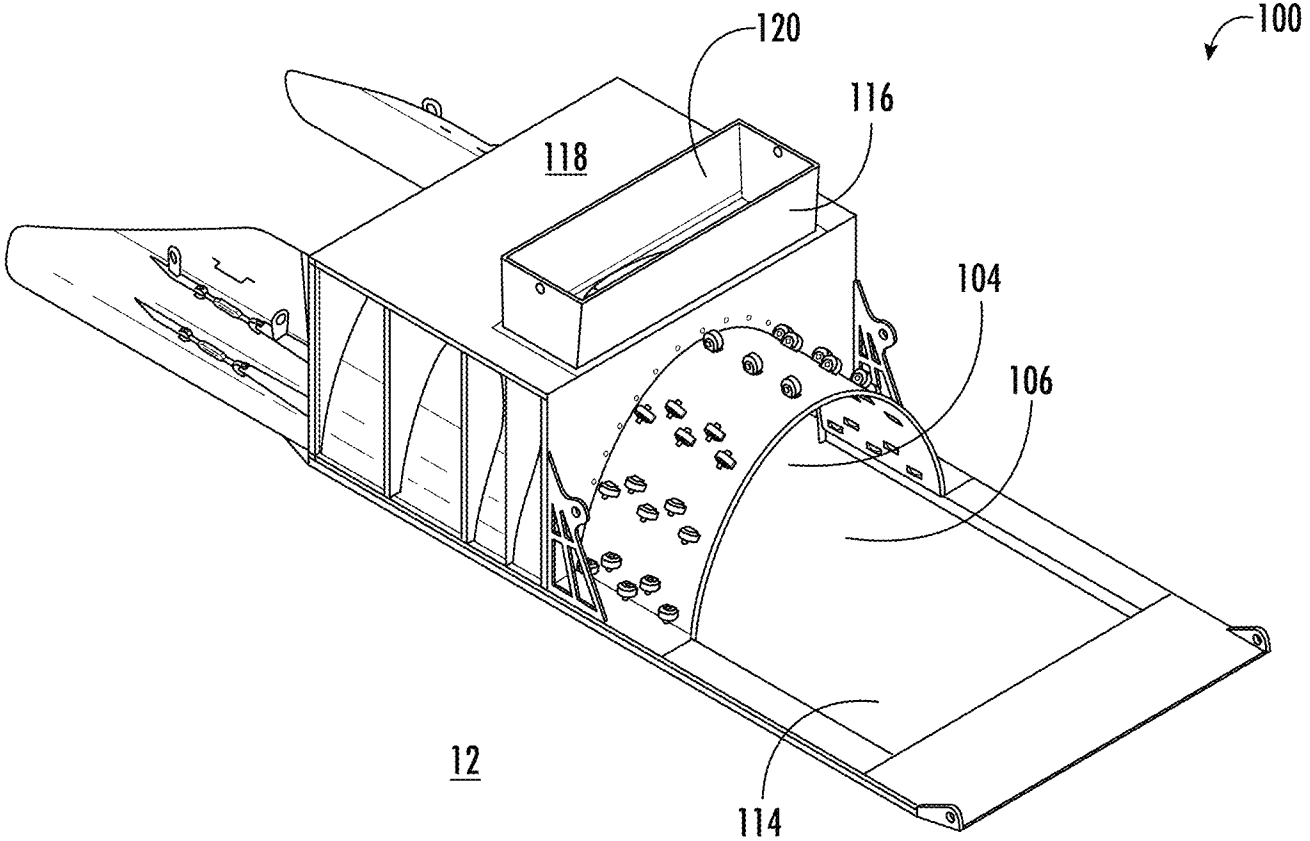
FIG. 1 is a perspective view of a concrete arch sled according to some embodiments.

Detailed aspects and applications of the disclosure are described below in the following drawings and detailed description of the technology. Unless specifically noted, it is intended that the words and phrases in the specification and the claims be given their plain, ordinary, and accustomed meaning to those of ordinary skill in the applicable arts.

In the following description, and for the purposes of explanation, numerous specific details are set forth in order to provide a thorough understanding of the various aspects of the disclosure. It will be understood, however, by those skilled in the relevant arts, that embodiments of the technology disclosed herein may be practiced without these specific details. It should be noted that there are many different and alternative configurations, devices and technologies to which the disclosed technologies may be applied. The full scope of the technology disclosed herein is not limited to the examples that are described below.

The singular forms "a," "an," and "the" include plural referents unless the context clearly dictates otherwise. Thus, for example, reference to "a step" includes reference to one or more of such steps.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

Throughout the description and claims of this specification, the words "comprise" and "contain" and variations of the words, for example "comprising" and "comprises", mean "including but not limited to", and are not intended to (and do not) exclude other components.

As required, detailed embodiments of the present disclosure are included herein. It is to be understood that the disclosed embodiments are merely exemplary of the invention that may be embodied in various forms. Therefore, specific structural and functional details disclosed herein are not to be interpreted as limits, but merely as a basis for teaching one skilled in the art to employ the present invention. The specific examples below will enable the disclosure to be better understood. However, they are given merely by way of guidance and do not imply any limitation.

The present disclosure may be understood more readily by reference to the following detailed description taken in connection with the accompanying figures and examples, which form a part of this disclosure. It is to be understood that this disclosure is not limited to the specific materials, devices, methods, applications, conditions, or parameters described and/or shown herein, and that the terminology used herein is for the purpose of describing particular embodiments by way of example only and is not intended to be limiting of the claimed inventions. The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

More specifically, this disclosure, its aspects and embodiments, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

In light of the issues with traditional stormwater retention system outlined above, there is a growing need for more durable and sustainable alternatives to plastic stormwater retention arches. The present disclosure is related to a cast-in-place concrete structure that offers the potential for enhanced structural performance, as this allows the structure to be custom-shaped to fit specific site conditions. In addition, the concrete structure can be reinforced to withstand heavy loads and environmental stresses. Lastly, cast-in-place concrete arches eliminate the environmental concerns associated with plastic materials, as concrete is non-toxic and can be produced with lower environmental impact when sourced and processed responsibly. The present disclosure also is a more cost-effective solution, making it even more desirable.

The present disclosure is related to a method for forming an elongated concrete structure, such as an elongated concrete arch 10. The elongated concrete structure may be cast in place by pouring concrete into a sled 100, which is discussed in more detail below, and then allowing the concrete to cure.

The sled 100 may have a bottom surface 102 that is flat. The sled 100 may be positioned in an initial position, as shown in FIG. 1. The initial position may be on a flat ground surface 12 upon which the elongated concrete arch 10 is to be formed. The flat ground surface 12 may be any flat surface and may be any material. For example, the flat ground surface 12 may be gravel, soil, dirt, or any other material. The flat ground surface 12 may be permeable to water such that, after the elongated concrete arch 10 has been formed and water collects between the elongated concrete arch 10 and the flat ground surface 12, the flat ground surface 12 allows the water to dissipate and drain through the flat ground surface 12. Thus, the elongated concrete arch 10 may be configured to receive stormwater and allow the stormwater to absorb into ground beneath the elongated concrete arch 10.

Figure 2:
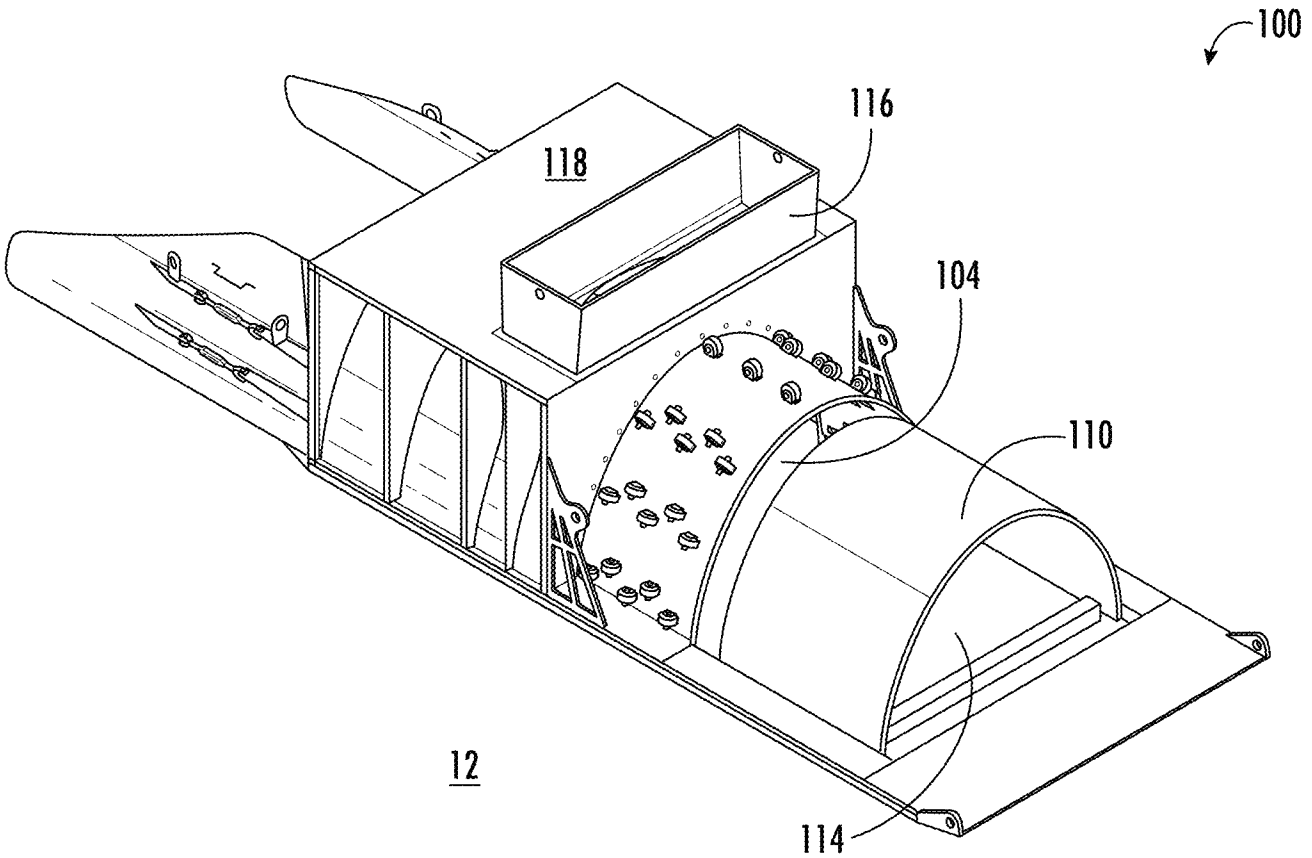
FIG. 2 is a perspective view of the concrete arch sled shown in FIG. 1 with a first form positioned adjacent to the entrance to the central passage according to some embodiments.

The sled 100 may have a central passage 104 that is formed as a tunnel extending beneath the sled 100, as shown in FIG. 1. The central passage 104 may be open beneath the sled 100 such that there is no barrier between the central passage 104 and the flat ground surface 12. This allows the elongated concrete structure to rest on the flat ground surface 12 as it is formed, and therefore also allows the sled 100 to slide forward without interference from the elongated concrete structure as the elongated concrete structure is formed because the elongated concrete structure is supported on the flat ground surface 12 and not on any portion of the sled 100. The central passage 104 may have an entrance 106 to the central passage 104 of the sled 100. The entrance 106 allows a form 108 to be inserted into the central passage 104 through the entrance 106. The form 108 is a temporary or reusable structure that is configured to provide the desired shape and support for the cast-in-place concrete during the pouring and curing process. Thus, the form 108 may have an arched shape. The form 108 is configured to maintain the specific dimensions and curvature of the concrete arch while ensuring structural integrity until the concrete achieves sufficient strength to sustain its own weight and any applied loads. After the concrete has sufficiently cured, the form 108 may be removed. The form 108 may be made from materials such as metal, plastic, wood, or any other suitable material. The entrance 106 may be located adjacent to an aperture 114 extending through the sled 100 within a footprint of the sled 100 (see FIG. 10). The aperture 114 allows the form 108 to be properly positioned on the flat ground surface 12 prior to moving the sled 100 to pass the form 108 into the central passage 104, as shown in FIG. 2. Thus, the aperture 114 may be sized and shaped to fit the form 108 through the aperture 114.

Figure 3:
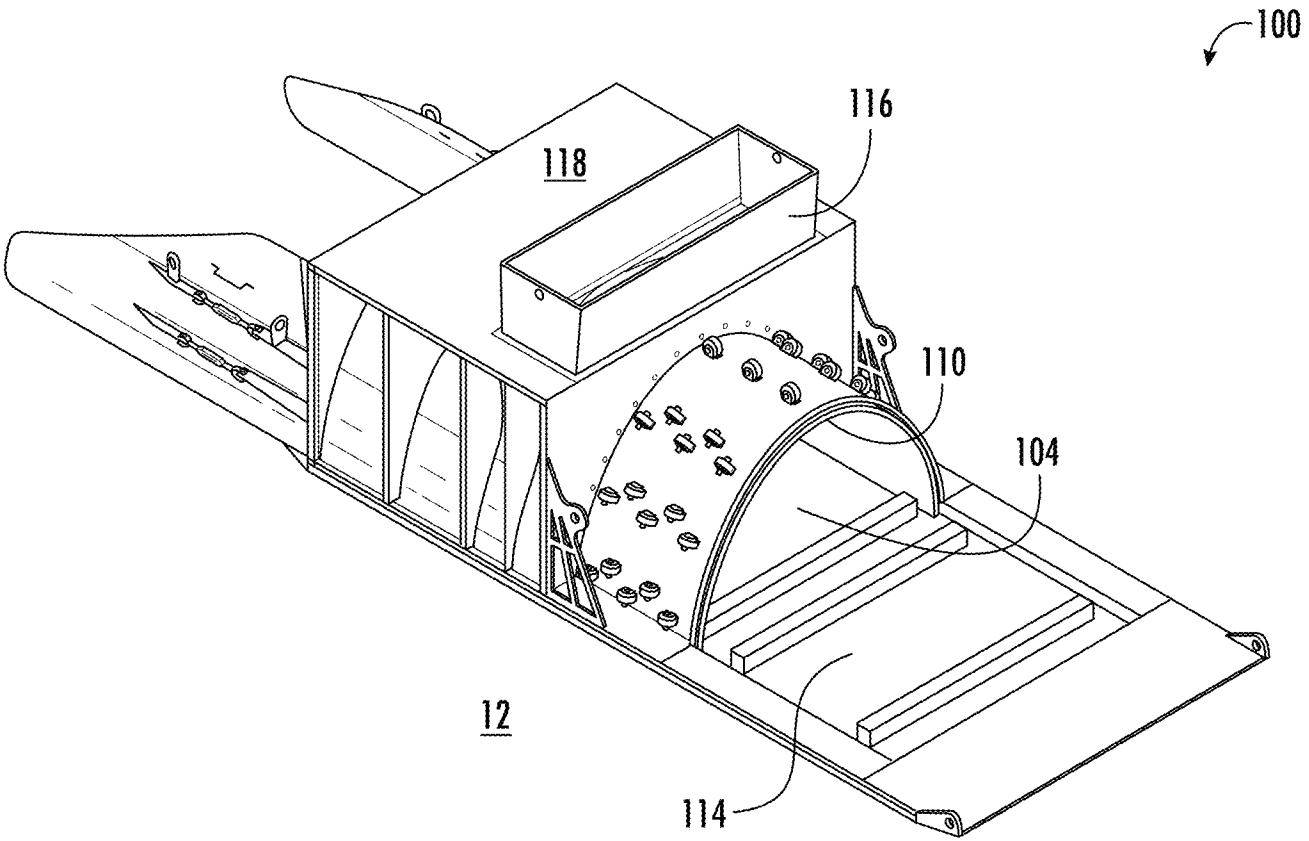
FIG. 3 is a perspective view of the concrete arch sled shown in FIG. 2 advanced forward such that the first form is positioned within the central passage according to some embodiments.

The method disclosed herein may involve multiple forms 108, including a first form 110 and a second form 112. Any number of forms 108 may be implemented, depending on the final length of the elongated concrete arch 10, where longer elongated concrete arches 10 will likely require more forms 108. Once the first form 110 is positioned on the flat ground surface 12 within a footprint of the sled 100 and adjacent to the entrance 106 to the central passage 104 of the sled 100, the sled 100 may be advanced to a first position, shown in FIG. 3. When the sled 100 is in the first position, the first form 110 is positioned beneath the sled 100 in the central passage 104. While advancing the sled 100 to the first position, the first form 110 may be formed into a desired shape with the sled 100. This may be done by contacting the first form 110 with the sled 100 and forcing the first form 110 into the desired shape, as described in more detail below. Forming the first form 110 into the desired shape may occur as a result of advancing the sled 100 forward to the first position in embodiments where the sled 100 is shaped to cause this to occur, such as in embodiments where the central passage 104 narrows slightly moving from the entrance 106 to the central passage 104 into the rest of the central passage 104.

Once the sled 100 is in the first position, there is space or a gap between the sled 100 and the first form 110. Concrete may be poured into a hopper 116 on an upper surface 118 of the sled 100. The hopper 116 may have a hopper opening 120 configured to receive concrete and pass the concrete further down into the sled 100. The space or gap between the sled 100 and the first form 110 may be filled with concrete received through the hopper opening 120 to form a first arched section 122 of the elongated concrete arch 10.

Figure 4:
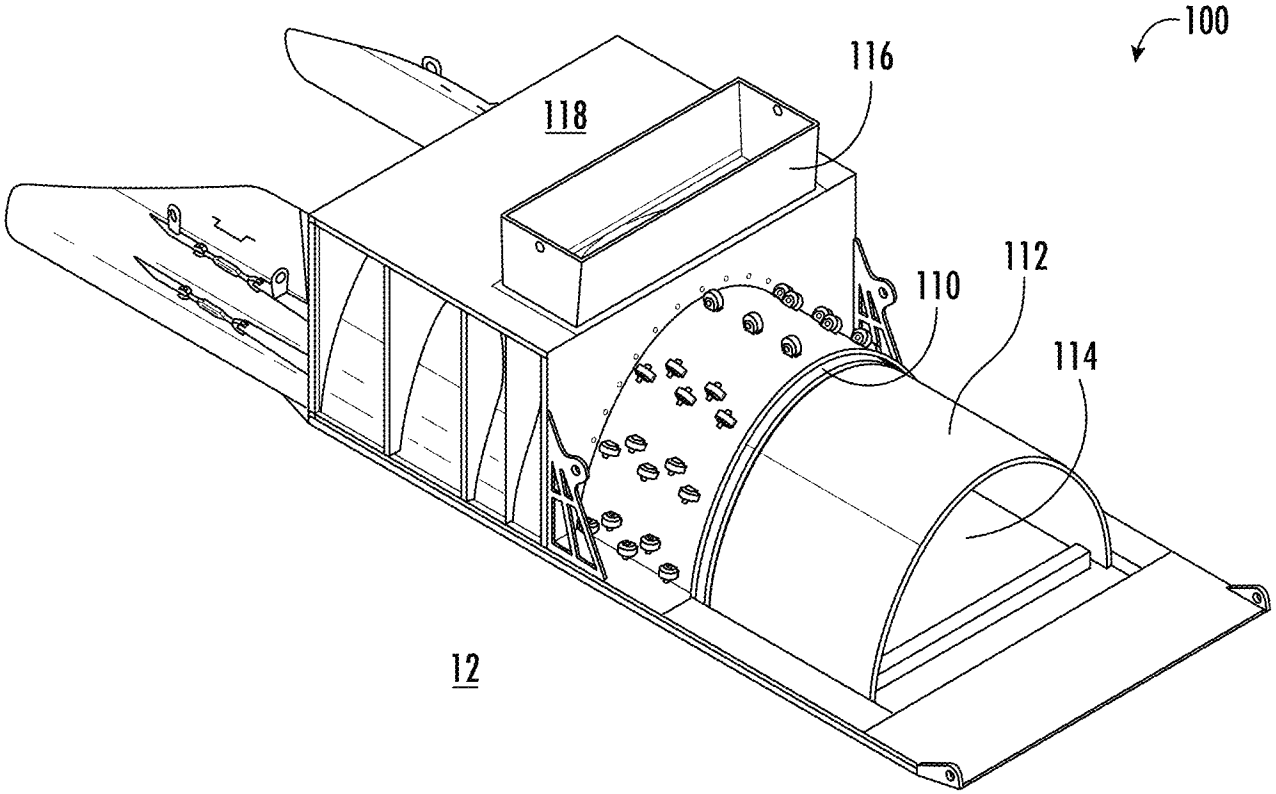
FIG. 4 is a perspective view of the concrete arch sled shown in FIG. 3 with a second form positioned adjacent to the entrance to the central passage according to some embodiments.
Figure 5:
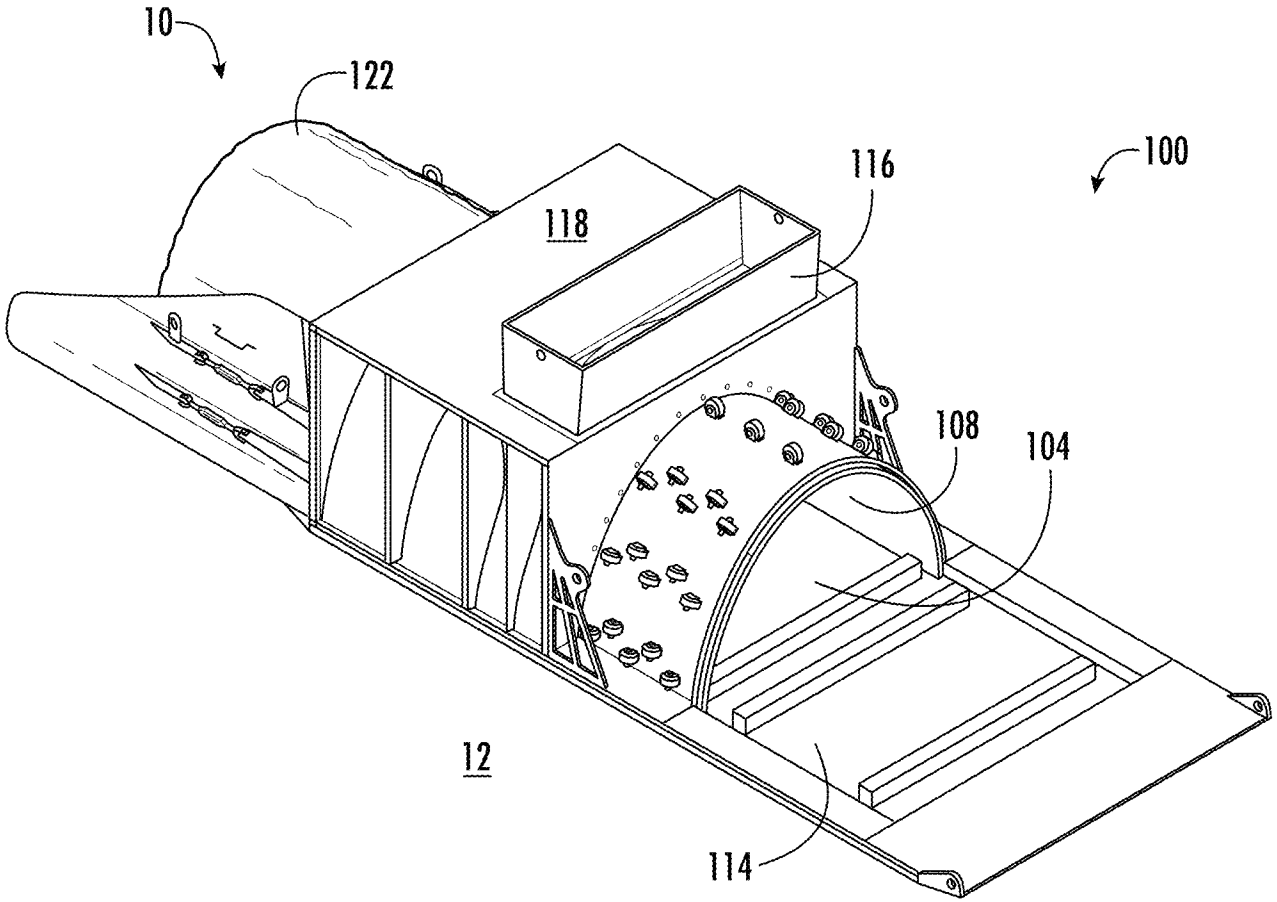
FIG. 5 is a perspective view of the concrete arch sled shown in FIG. 4 advanced forward such that the second form is positioned within the central passage according to some embodiments.

The second form 112 may be positioned on the flat ground surface 12 within the footprint of the sled 100 and adjacent to the entrance 106 of the central passage 104 of the sled 100 and may be positioned to be aligned with and adjacent to the first form 110, as shown in FIG. 4. This allows a continuous elongated concrete arch 10 to be formed. Once the second form 112 is positioned properly, the sled 100 may be advanced forward to a second position, shown in FIG. 5. When in the second position, the second form 112 is positioned beneath the sled 100 in the central passage 104. While advancing the sled 100 to the second position, the second form 112 may be formed into a desired shape with the sled 100. This may be done by contacting the second form 112 with the sled 100 and forcing the second form 112 into the desired shape, as described in more detail below. Forming the second form 112 into the desired shape may occur as a result of advancing the sled 100 forward to the second position in embodiments where the sled 100 is shaped to cause this to occur, such as in embodiments where the central passage 104 narrows slightly moving from the entrance 106 to the central passage 104 into the rest of the central passage 104.

As with the first form 110 when the sled 100 is in the first position, once the sled 100 is in the second position, there is space or a gap between the sled 100 and the second form 112. Concrete may be poured into the hopper opening 120 of the hopper 116. The space or gap between the sled 100 and the second form 112 may be filled with concrete received through the hopper opening 120 to form a second arched section 124 of the elongated concrete arch 10. The word "fill" is used herein to indicate that concrete is poured between the sled and the respective forms and that the concrete settles from gravity so that it is substantially filling the space, or filling a majority of the space. It will be understood, however, that there may be some air gaps or other unfilled portions remaining after the space is filled. The second arched section 124 of the elongated concrete arch 10 may be positioned on the flat ground surface 12 aligned with the first arched section 122 and may be in direct contact with the first arched section 122. In some embodiments, the first arched section 122 and the second arched section 124 may be integrally formed by pouring the concrete for the second arched section 124 before the first arched section 122 has cured.

Figure 6:
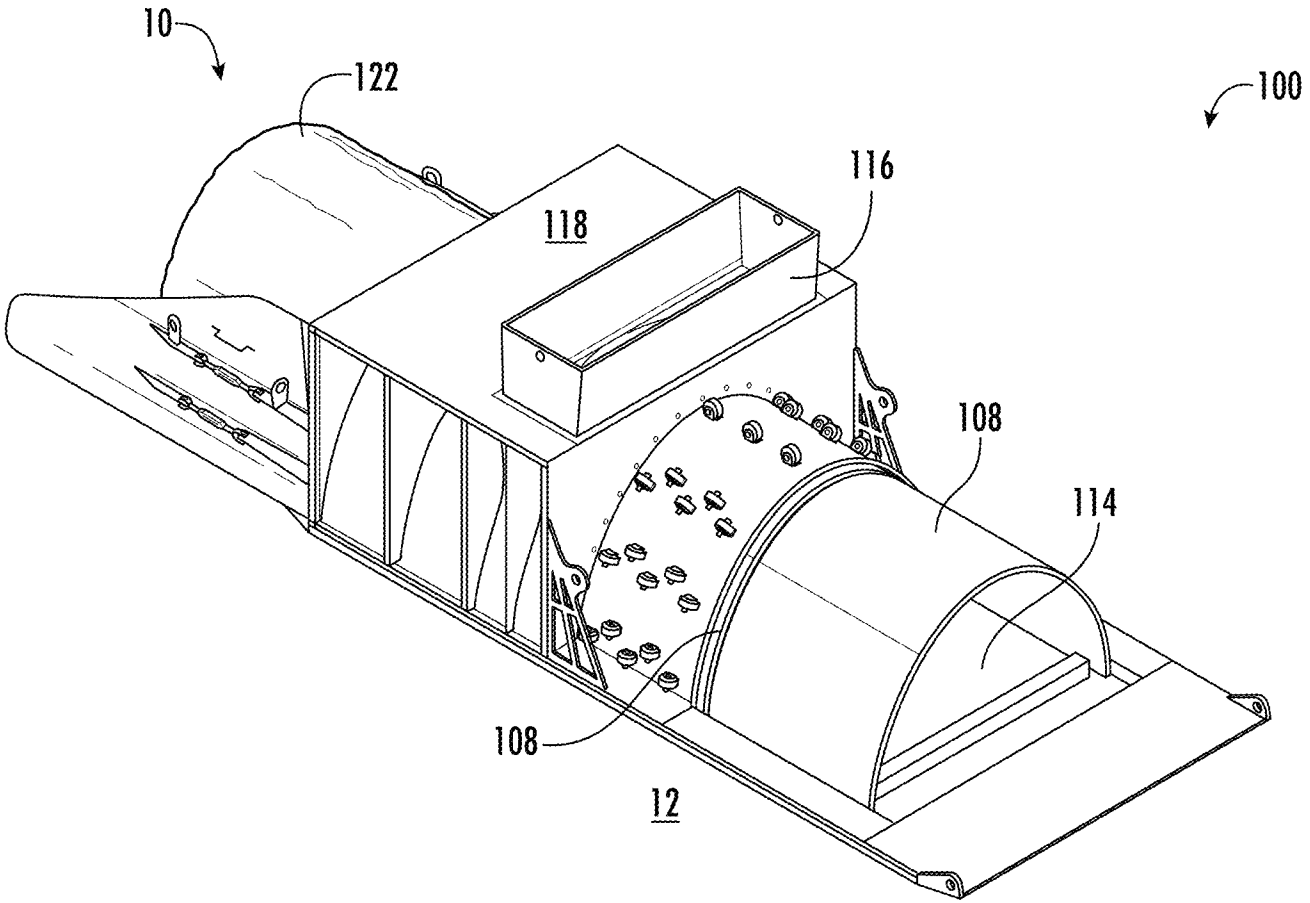
FIG. 6 is a perspective view of the concrete arch sled shown in FIG. 5 with a third form positioned adjacent to the entrance to the central passage according to some embodiments.
Figure 7:
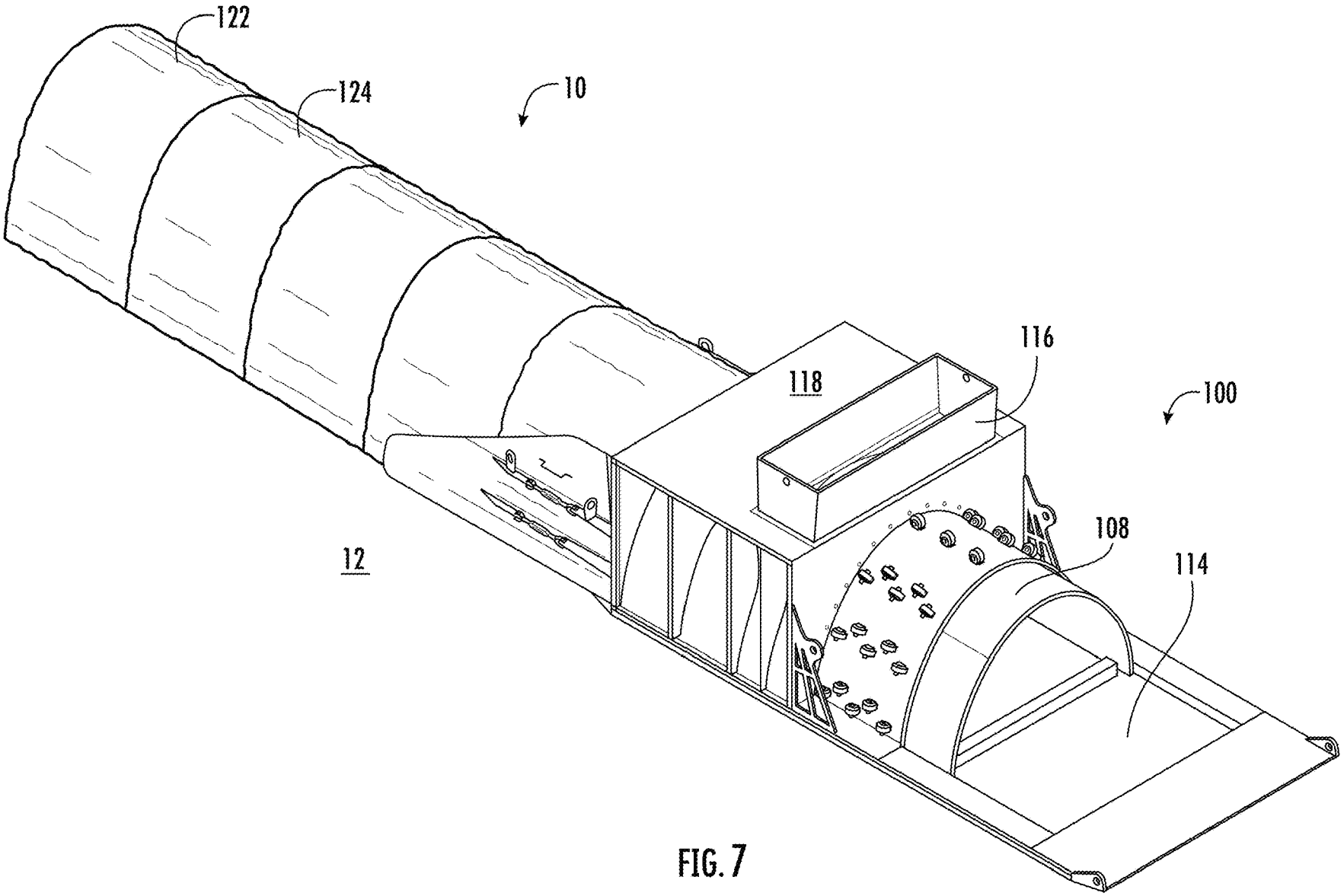
FIG. 7 is a perspective view of the concrete arch sled shown in FIG. 6 advanced forward such that a plurality of forms has passed through the central passage.
Figure 8:
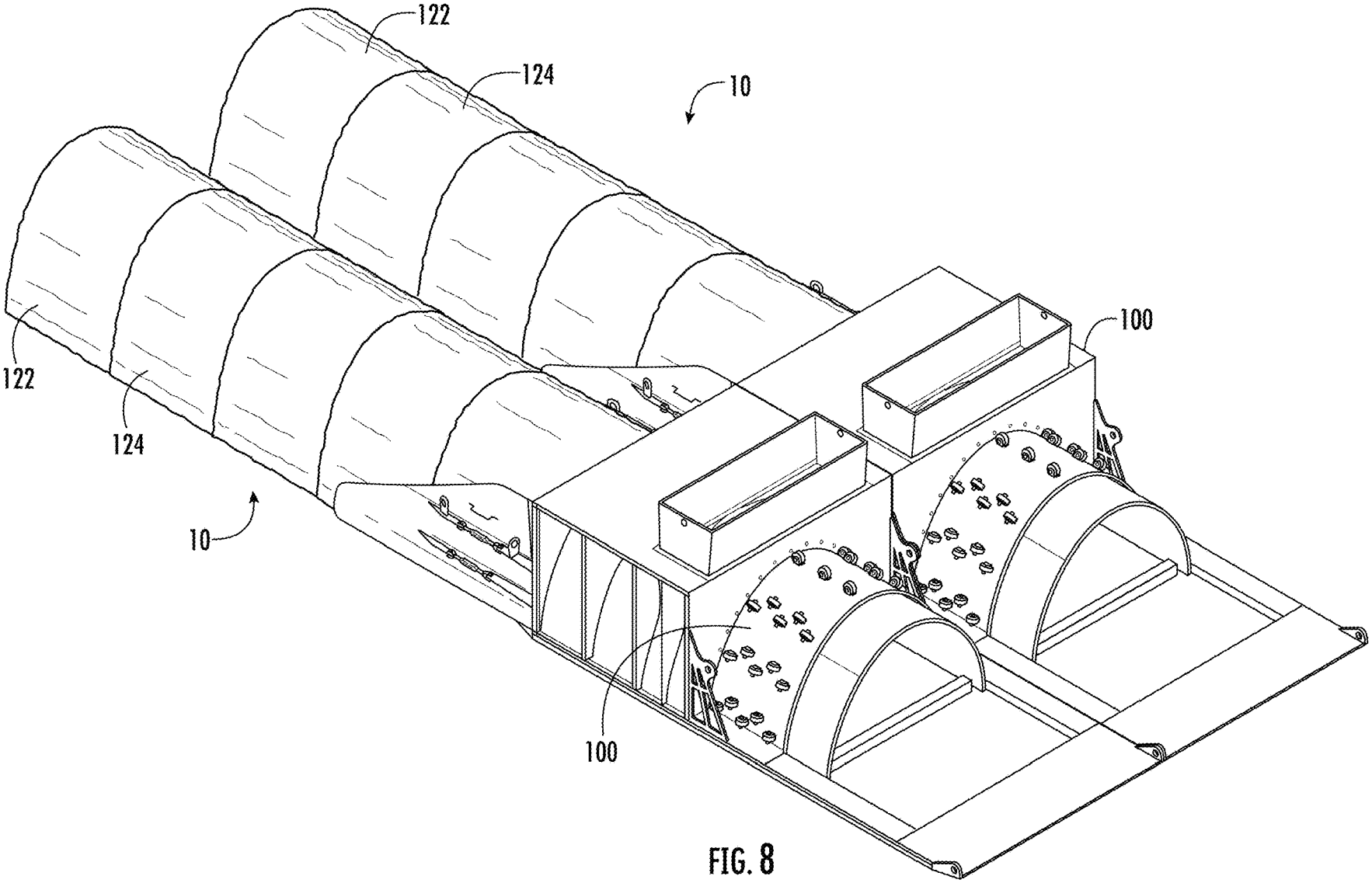
FIG. 8 is a perspective view of multiple concrete arch sleds being used simultaneously, side by side, according to some embodiments.

The process explained above may be continued for any number of forms 108 to create any number of arched sections until the desired length of the elongated concrete arch 10, as shown in FIGS. 6-7. In addition, in some embodiments, the arched sections, including the first arched section 122 and the second arched section 124 may not be distinct, and may instead be visually indistinguishable from each other. For example, in some embodiments, concrete may be poured continuously as the sled 100 is continuously moved forward. In such embodiments, the concrete in the hopper 116 moves to fill the space or gap between the sled 100 and the forms 108 as the sled 100 moves forward. In other words, in some embodiments, filling the space between the forms 108 and the sled 100 with concrete occurs while advancing the sled 100 forward from the initial position to the first position and from the first position to the second position. In some embodiments, advancing the sled 100 forward from the initial position to the first position and from the first position to the second position occurs at a constant rate. This constant rate may be at least 3 inches per minute, at least 4 inches per minute, at least 5 inches per minute, or any other constant rate. As space is created in the aperture 114 extending through the sled 100 due to the forward movement of the sled 100, additional forms 108 can be positioned on the flat ground surface 12 to then enter into the central passage 104 of the sled 100 as the sled 100 continues to advance. Thus, the method disclosed herein is related both to a continuous process and to an intermittent process. The process explained above may also be implemented with multiples sleds 100 being used simultaneously, side by side, to form multiple elongated concrete arches 10 running parallel with each other, as shown in FIG. 8.

As mentioned above, the forms 108 are configured to be removed from the elongated concrete arch 10 once the concrete has sufficiently cured to maintain the specific dimensions and curvature of the concrete arch. In some embodiments, each form 108 is removed from the elongated concrete arch 10 within 60 minutes of filling the space between that particular form 108 and the sled 100. In different embodiments, this time may be more or less, such as within 45 minutes, within 75 minutes, within 90 minutes, or within 2 hours. This may be enabled by preparing the concrete prior to pouring so that the concrete can reach a point where it can sufficiently hold its shape within the desired amount of time. For example, the concrete poured into the hopper 116 may have a slump of between 0.5 and 1.5 inches. Slump is a measure of the consistency and workability of fresh concrete and is determined by performing a slump test, which involves filling a slump cone with concrete, removing the cone, and measuring the distance the concrete falls. In some embodiments, the concrete poured into the hopper 116 may have a slump of less than 2 inches.

Figure 9:
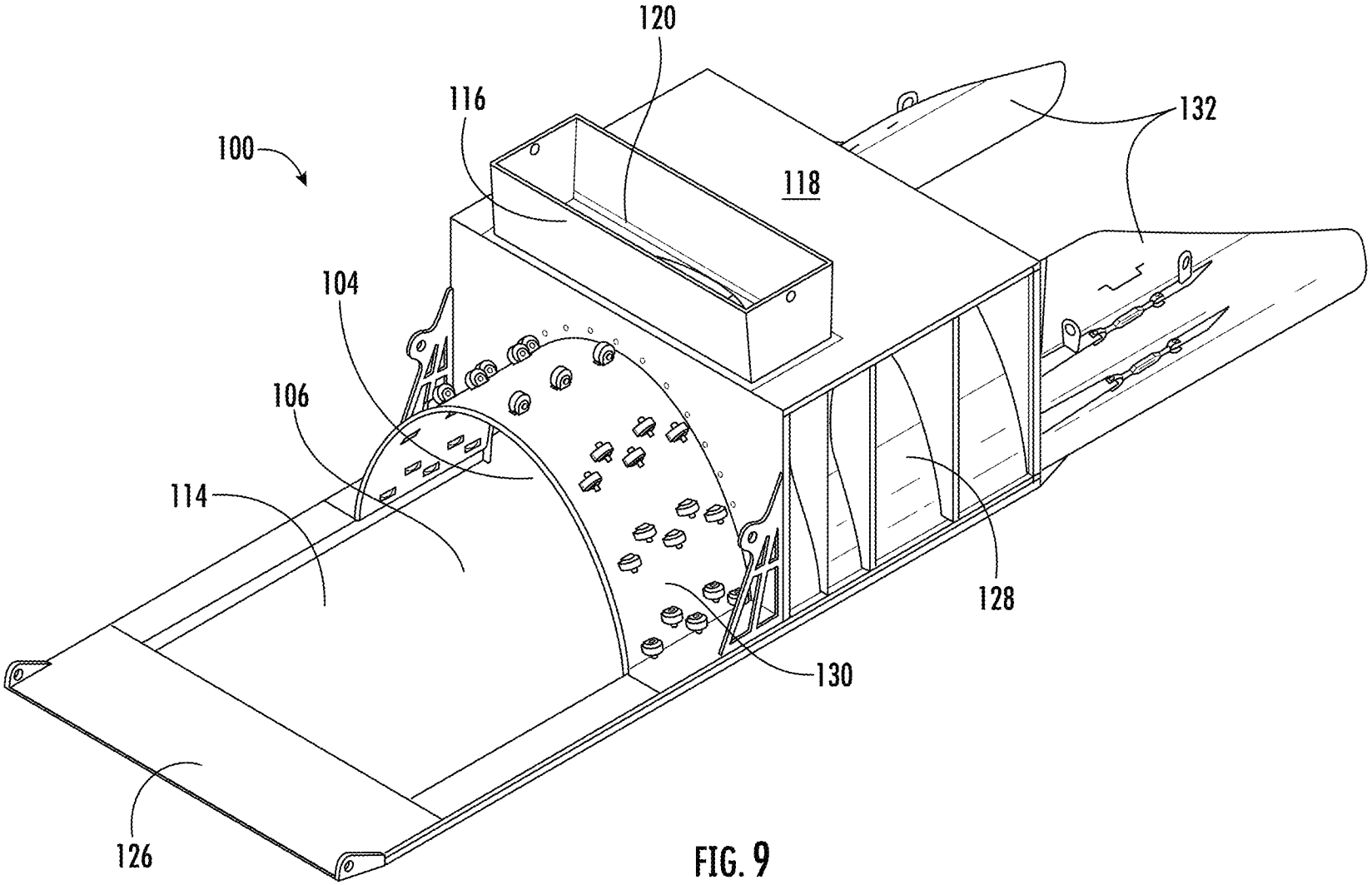
FIG. 9 is a perspective view of a concrete arch sled according to some embodiments.
Figure 10:
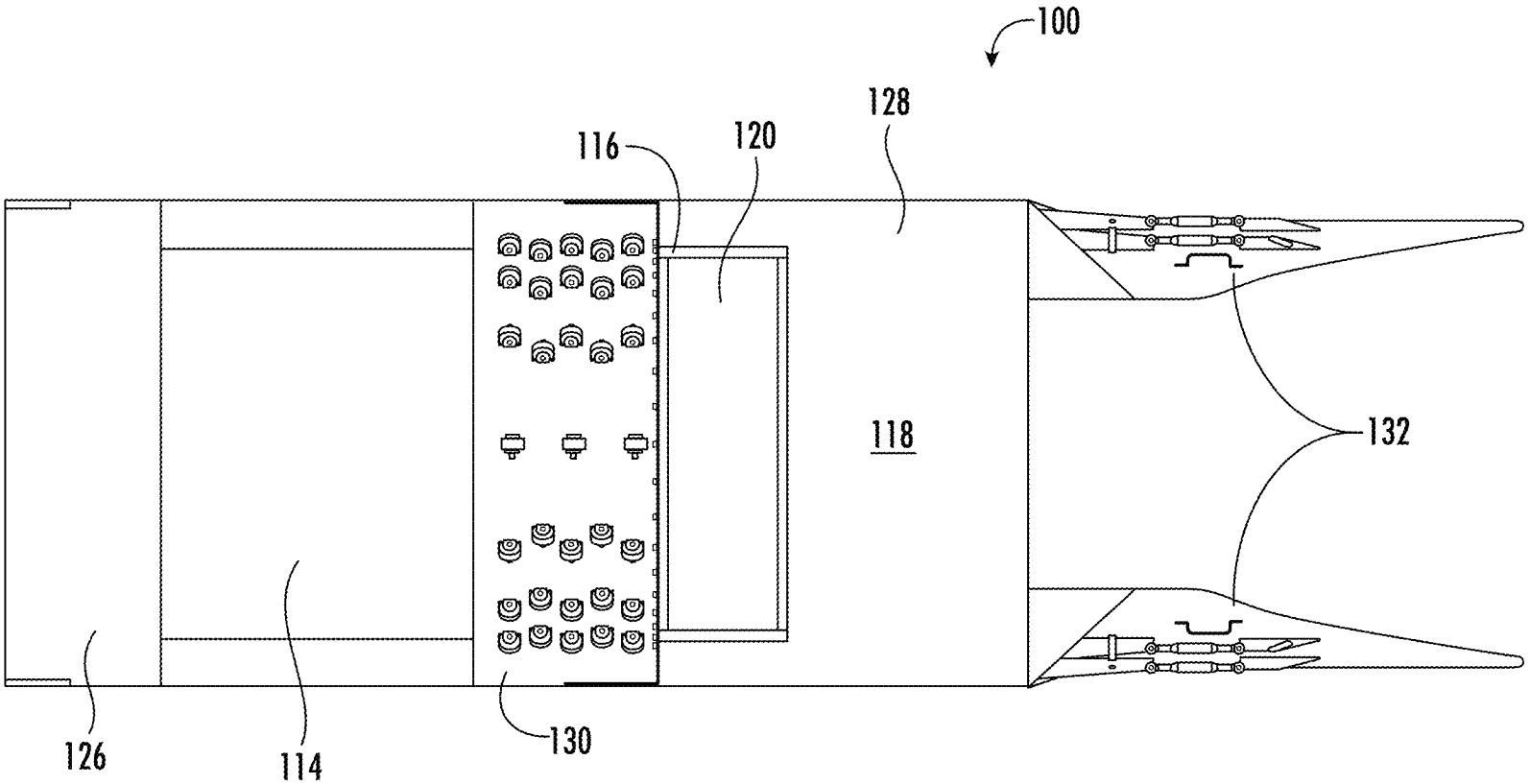
FIG. 10 is a top view of a concrete arch sled according to some embodiments.
Figure 11:
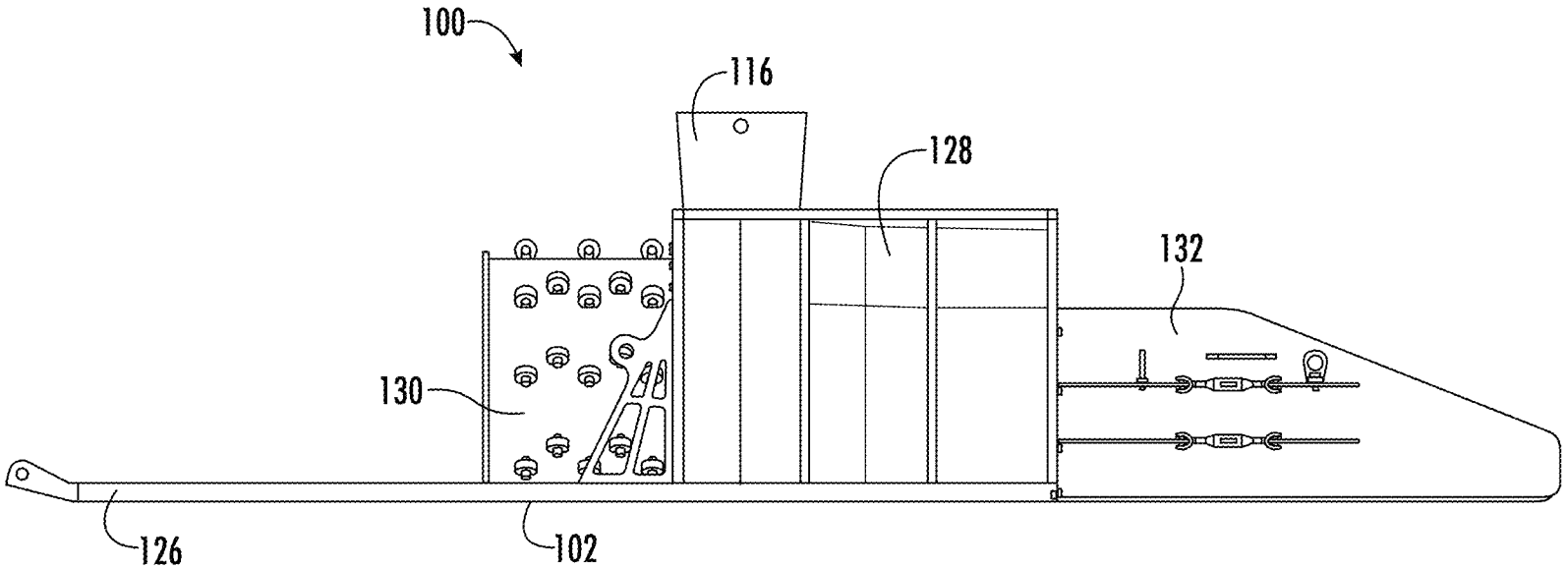
FIG. 11 is a side view of a concrete arch sled according to some embodiments.
Figure 12:
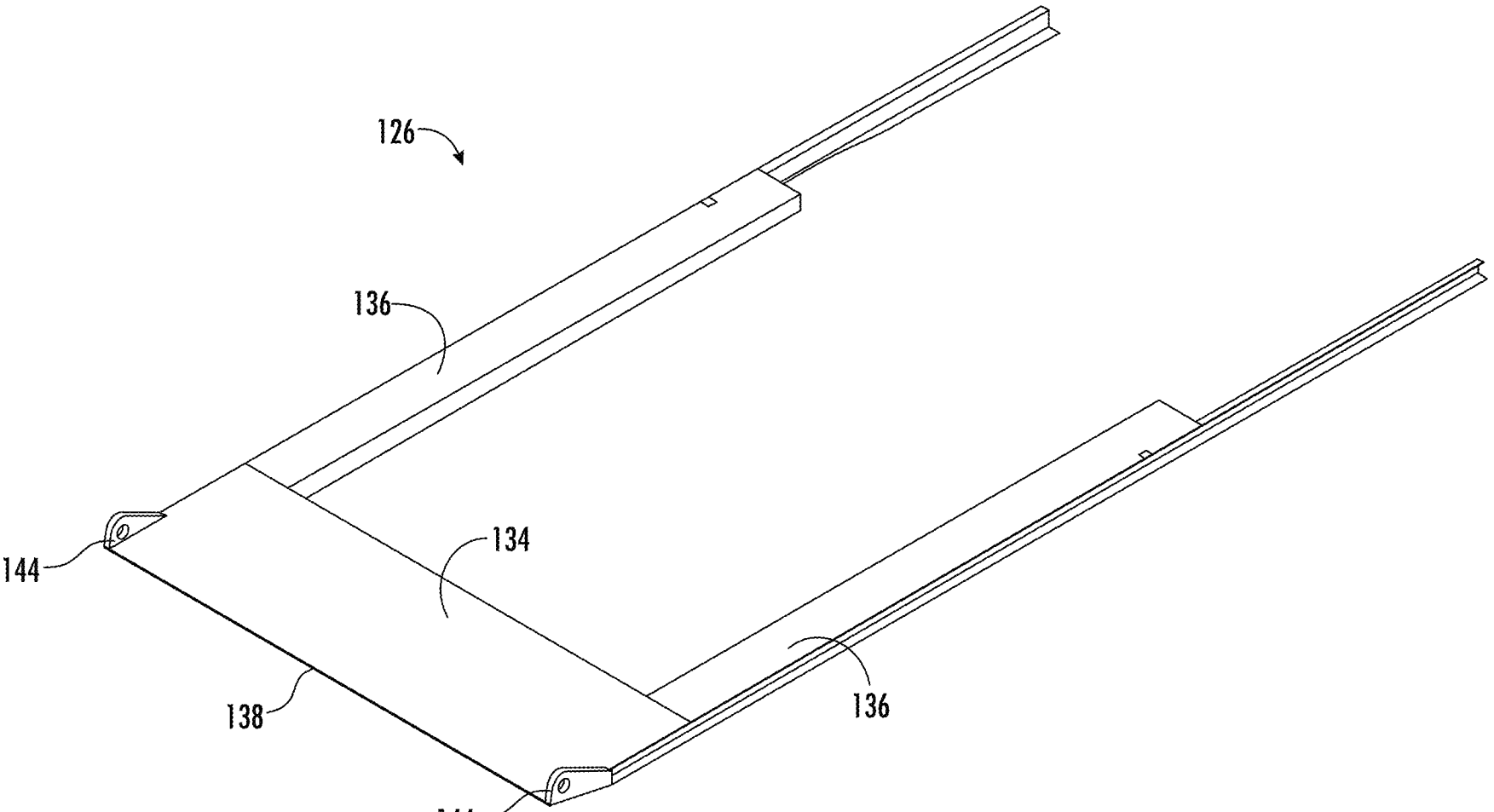
FIG. 12 is a perspective view of a sled base of a concrete arch sled according to some embodiments.
Figure 13:
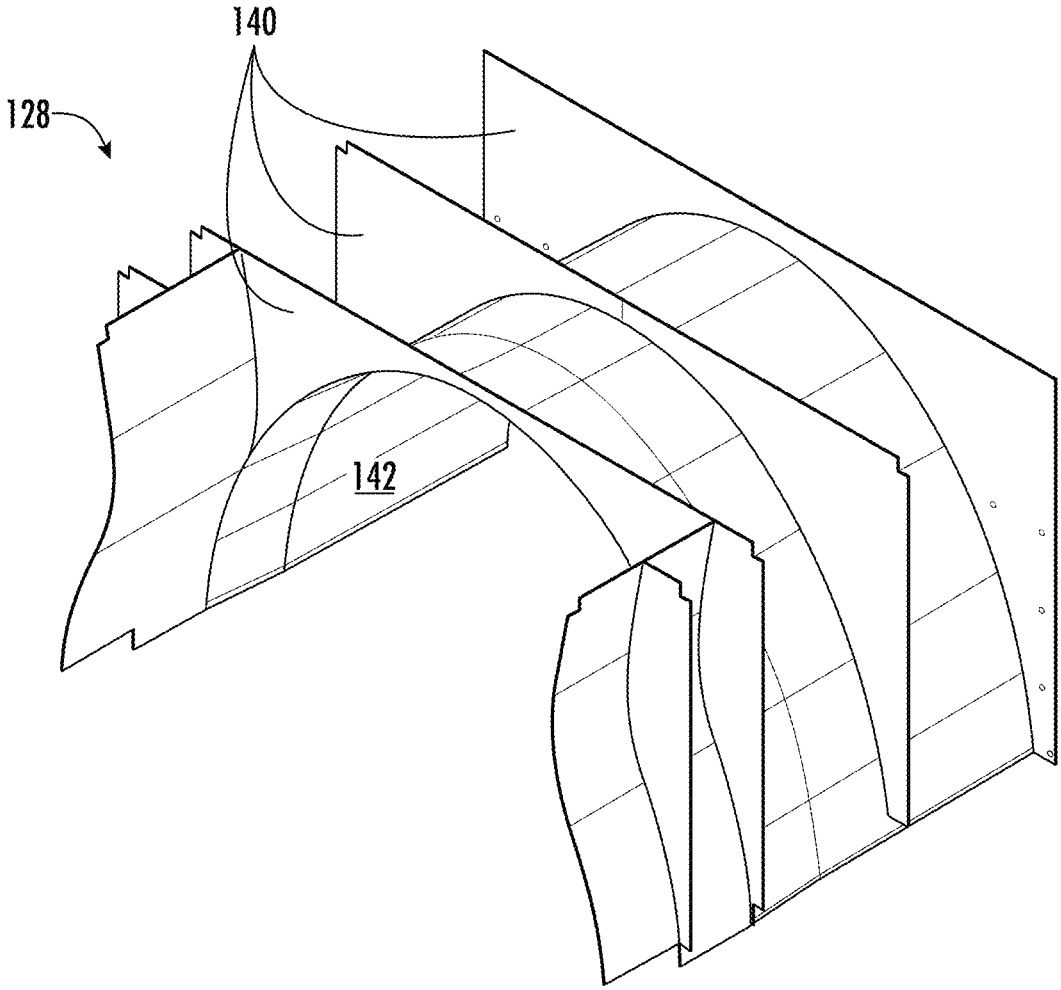
FIG. 13 is a perspective view of a frame of a concrete arch sled according to some embodiments.
Figure 19:
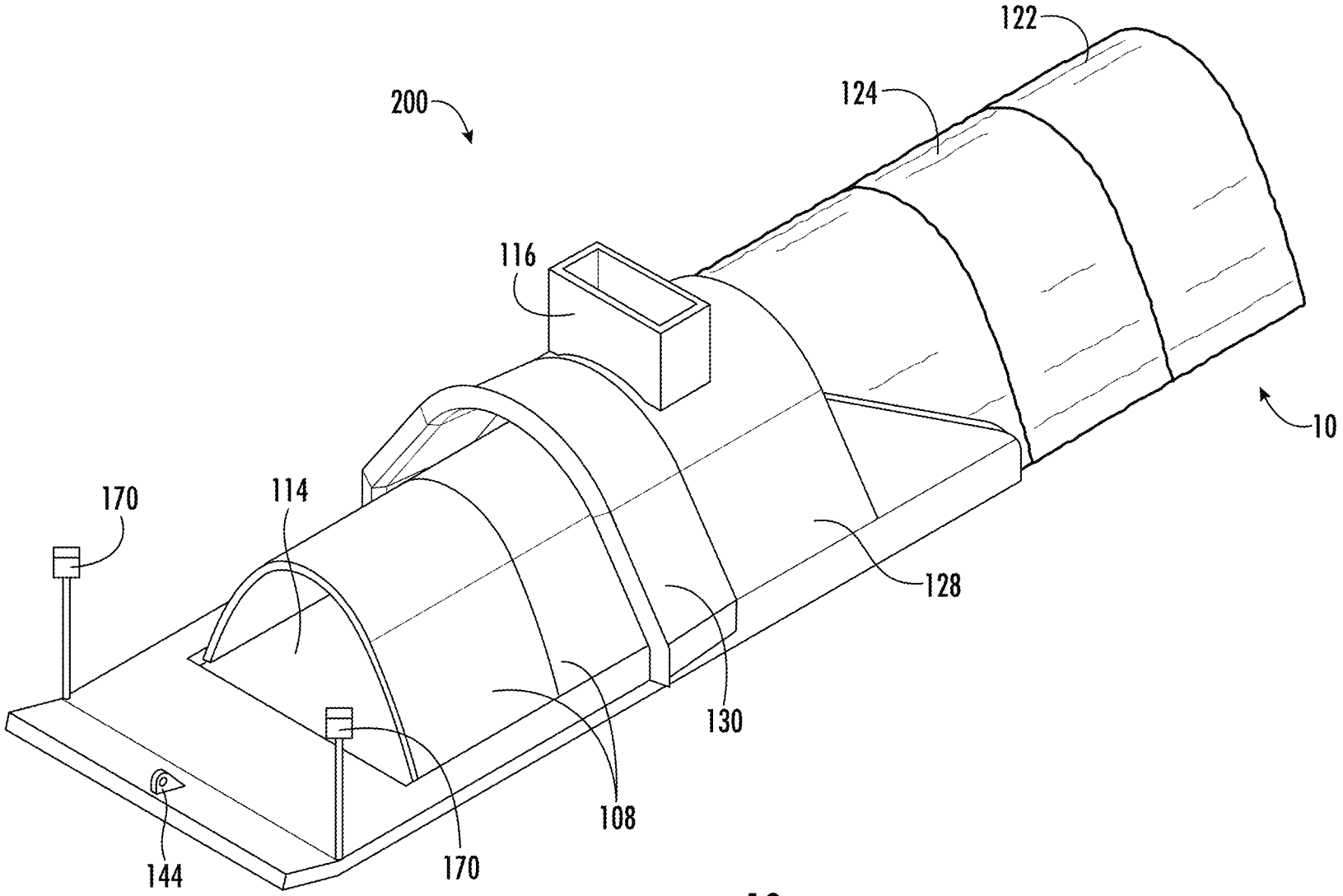
FIG. 19 is a perspective view of a concrete arch sled according to some embodiments.

The sled 100 may also comprise a sled base 126, a frame 128, a mandrel assembly 130, and/or a trailing skirt extension 132, as shown in FIGS. 9-11. The sled base 126 is configured to stabilize the sled 100 on the flat ground surface 12 and is configured to provide the structure to support the rest of the sled 100. The sled base 126 may have a front rail 134 and side rails 136, as shown in FIG. 12. The front rail 134 and the side rails 136 border the aperture 114 through the sled 100. The front rail 134 may have a front lip 138 that is configured to be raised off of the flat ground surface 12. This facilitates forward movement of the sled 100 because the front edge thus does not dig into the flat ground surface 12. In addition, the front rail 134 may have one or more pull points 144. The pull points 144 are configured to provide a structure to grab or attach to the sled 100. For example, the pull points 144 may comprise a hole to which a rope or cable can be attached. The sled 100 can then be hauled forward using the rope or cable. The pull points 144 may be positioned at any point along the front rail 134. For example, the pull points 144 may be positioned on the corners of the front rail 134, as shown in FIG. 12 or may be centered on the front rail 134 as shown in FIG. 19.

Figure 14:
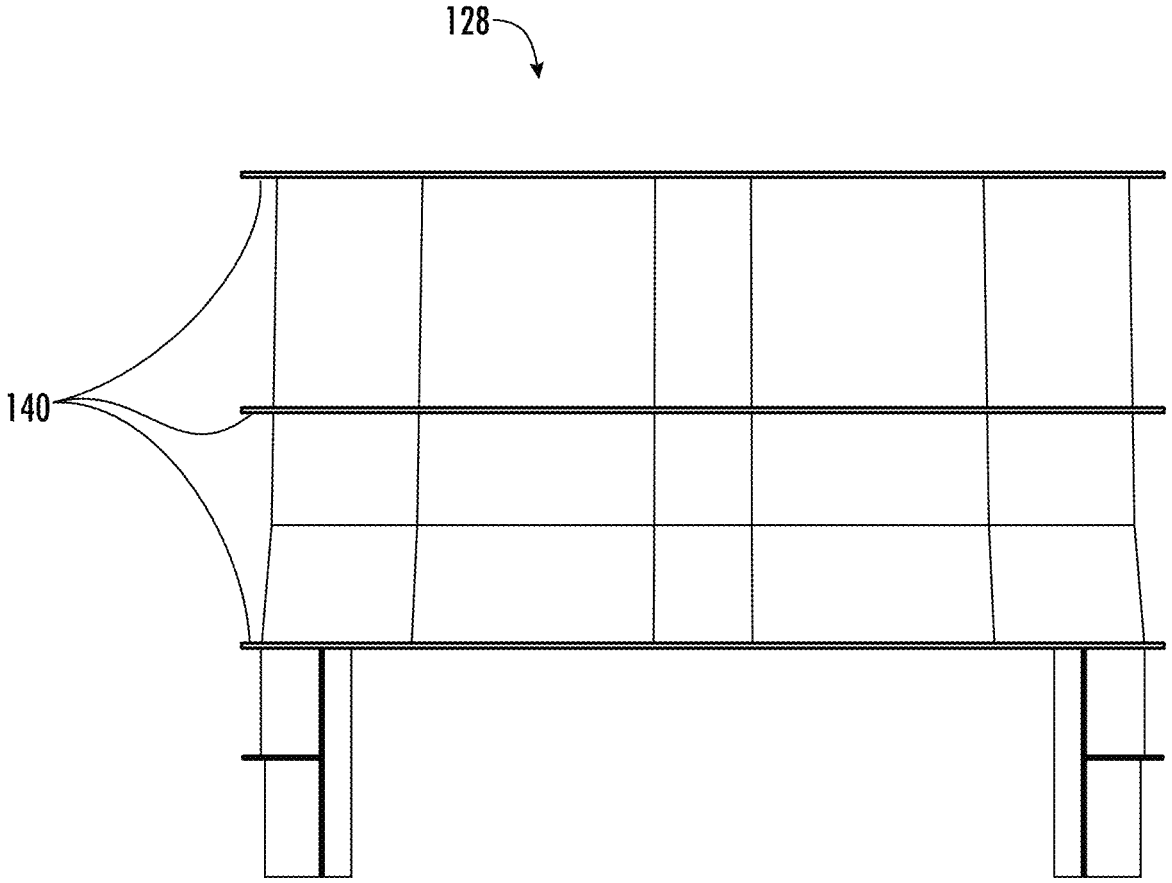
FIG. 14 is a top view of a frame of a concrete arch sled according to some embodiments.
Figure 15:
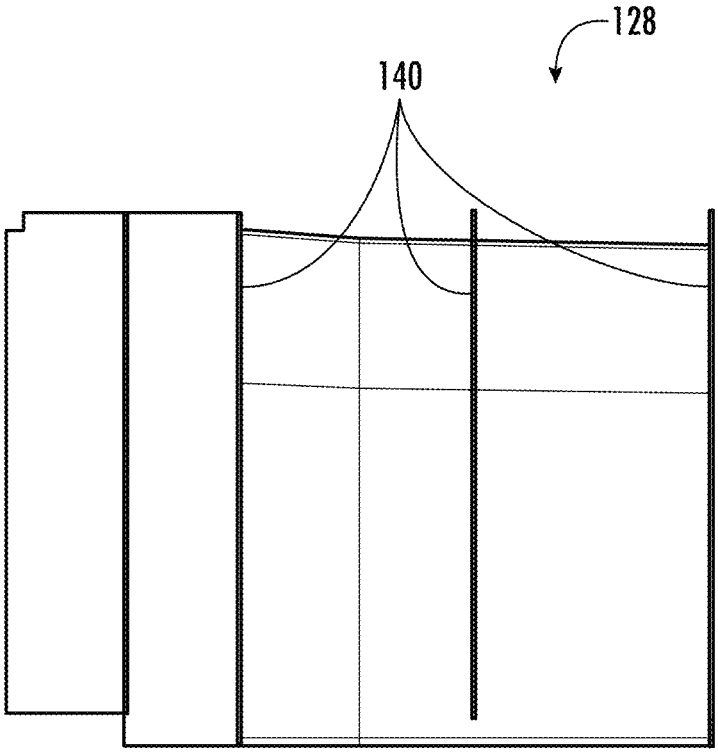
FIG. 15 is a side view of a frame of a concrete arch sled according to some embodiments.
Figure 16:
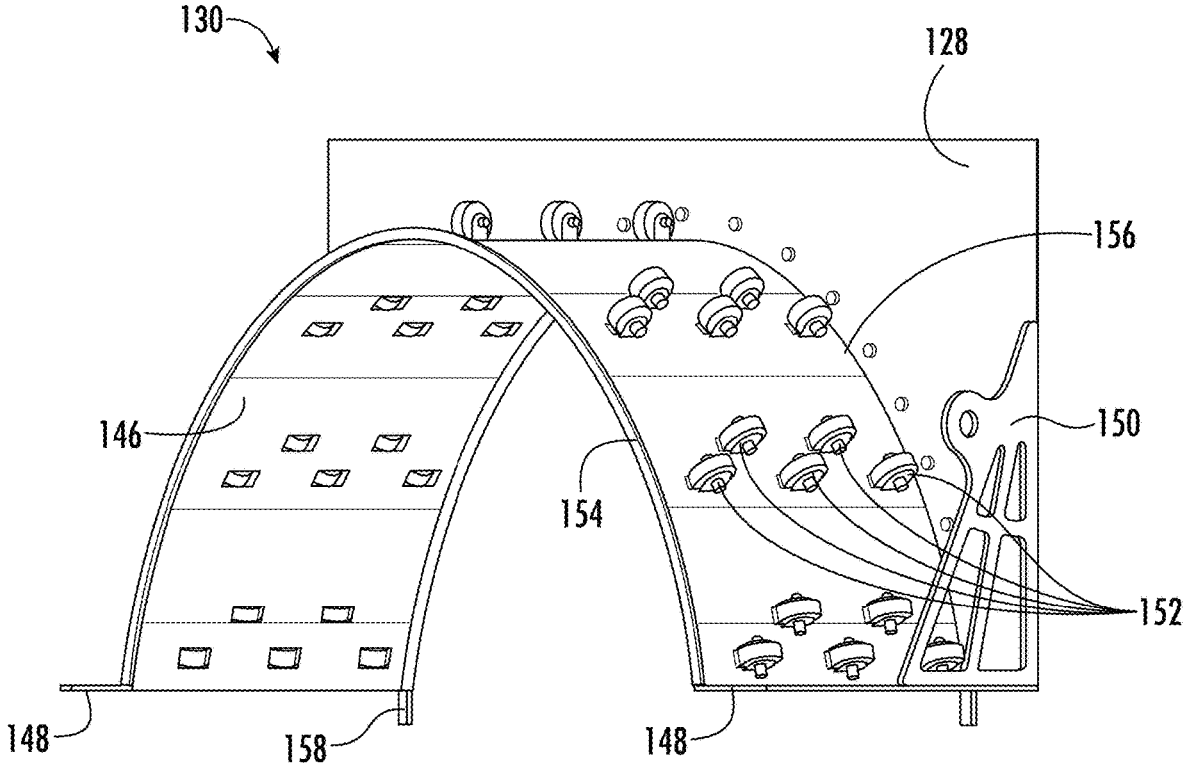
FIG. 16 is a perspective view of a hopper of a concrete arch sled according to some embodiments.

The frame 128 of the sled 100 is coupled to and supported by the sled base 126, as shown in FIGS. 9-11. The frame 128 provides the necessary structure to the sled 100 so that forms 108 can pass beneath the sled 100 and the elongated concrete arch 10 can be cast between the forms 108 and the sled 100. For example, the frame 128 may have a plurality of struts 140 that are configured to stiffen the frame 128 and help the frame 128 to hold the desired shape, such as an arch. The plurality of struts 140 are also configured to support the hopper 116 (shown in FIG. 17) above the frame 128, as illustrated in FIGS. 9-11. The frame 128 may have a casting surface 142 that is configured to face the forms 108 when they are positioned in the central passage 104. The casting surface 142 therefore contacts the concrete as it is poured and casts the concrete in the desired shape. As shown in FIGS. 14 and 15, the casting surface 142 may be sloped slightly such that, moving from the front of the central passage 104 (adjacent to the aperture 114) toward the rear of the central passage 104 where the forms exit the central passage 104 as the sled 100 advances, the central passage 104 becomes smaller. This helps to compact the concrete as the sled 100 advances, thus creating a better cast structure. The hopper 116 may be positioned adjacent to the front of the central passage 104.

The mandrel assembly 130 is configured to contact the form 108 when the form 108 enters the central passage 104 and force the form 108 into the desired shape, as mentioned above. The mandrel assembly 130 may comprise an arch mandrel 146, mandrel feet 148, and/or a frame support 150 joining the mandrel feet 148 to the frame 128. The mandrel feet 148 extend along bottom edges of the arch mandrel 146 to stabilize the arch mandrel 146 against the sled base 126, as shown in FIG. 9. The arch mandrel 146 thus extends in an arch from one mandrel foot 148 to the other. The frame support 150 couples the mandrel feet 148 to the frame 128 and thus stabilizes the mandrel assembly 130 with respect to the frame 128. This helps to align the mandrel assembly 130 with the frame 128 so that, once the mandrel assembly 130 positions a form 108, the form 108 is properly aligned to be centered within the central passage 104.

Figure 17:
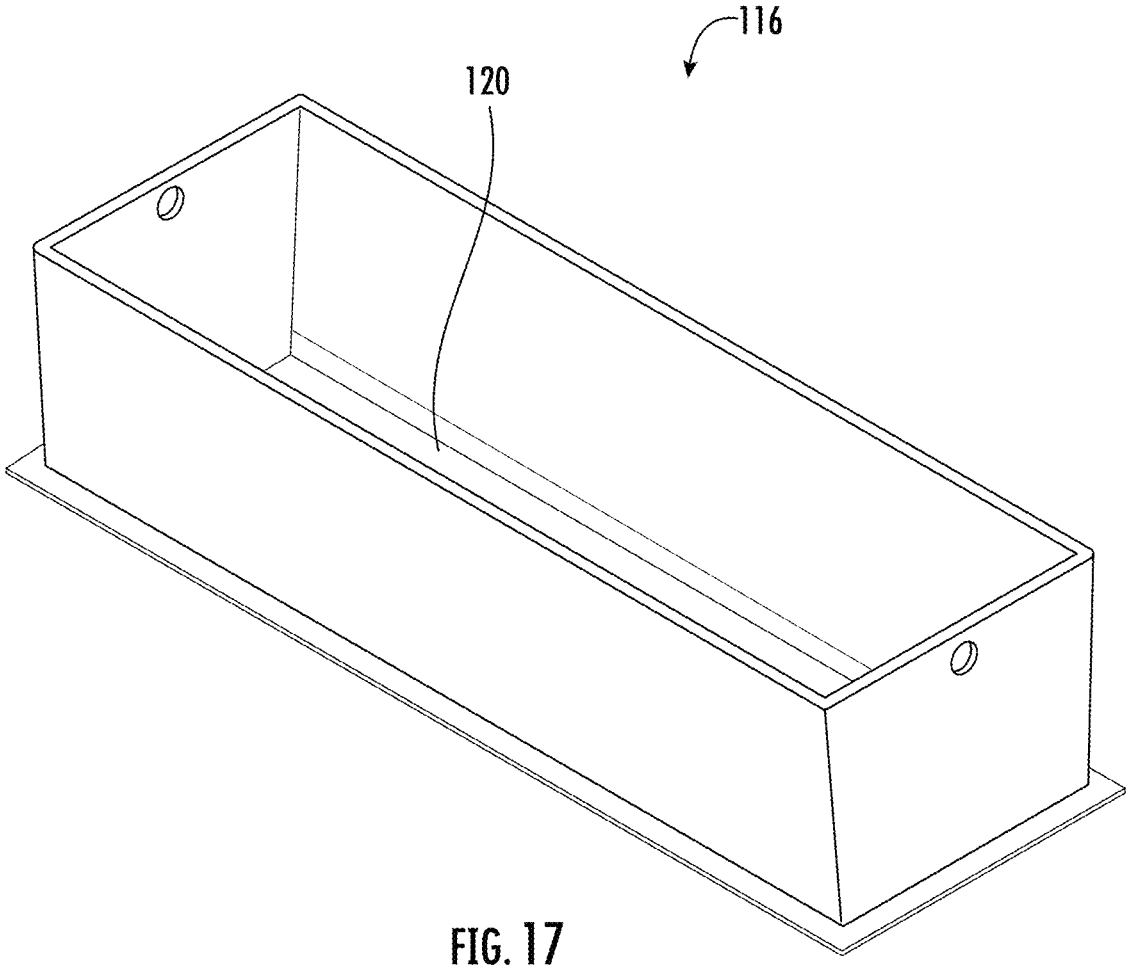
FIG. 17 is a perspective view of a mandrel assembly of a concrete arch sled according to some embodiments.

The arch mandrel 146 may have a plurality of guiding wheels 152 that are configured to force the forms 108 into the desired shape. The plurality of guiding wheels 152 is configured to reduce friction between the forms 108 and the arch mandrel 146 while still allowing the arch mandrel 146 to properly position the forms 108. The plurality of guiding wheels 152 may be arranged in rows, as shown in FIG. 17. Moving from a front side 154 toward a rear side 156 of the arch mandrel 146, each row of the plurality of guiding wheels 152 may progressively extend further past the arch mandrel 146 into the central passage 104. This facilitates the insertion of the forms 108 into the central passage 104 and allows each guiding wheel 152 to further adjust the position of the form 108 until the last guiding wheels 152 finalize the position of the form 108 before the form 108 is positioned beneath the hopper 116 and begins to support concrete as it is poured. The mandrel assembly 130 may also comprise a gasket 158, which may be formed of rubber, that is configured to provide a separation between the arch mandrel 146 and the casting surface 142 of the frame 128. As will be apparent to one of skill in the art, while the central passage 104 beneath the arch mandrel 146 is nearly the same size as the forms 108, the central passage 104 opens up beneath the frame 128 to provide space for the concrete to be injected between the forms 108 and the casting surface 142 of the frame 128. The gasket 158 is configured to maintain contact with the forms 108 so that concrete does not spread forward beneath the arch mandrel 146.

Figure 18:
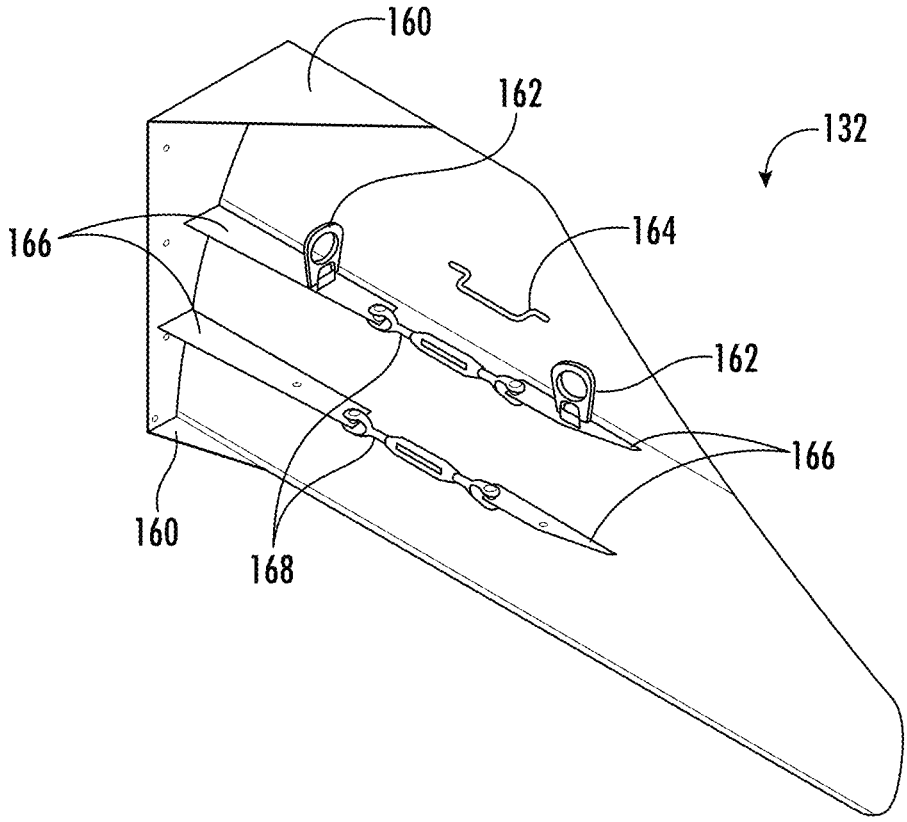
FIG. 18 is a perspective view of a trailing skirt extension of a concrete arch sled according to some embodiments.

The trailing skirt extension 132 is configured to provide continued support to the elongated concrete arch 10 once the sled 100 has advanced far enough that the elongated concrete arch 10 is no longer within the central passage 104. The sled 100 may comprise two trailing skirt extensions 132, one for each side of the sled 100, as shown in FIGS. 9-11. The trailing skirt extension 132 may have supports 160 extending between the trailing skirt extension 132 and the frame 128 to secure the trailing skirt extension 132 to the frame 128, as shown in FIG. 18. The trailing skirt extension 132 may also have lifting rings 162 and/or a lifting handle 164. The lifting rings 162 and lifting handle 164 provide a method of lifting the trailing skirt extension 132 and/or the sled 100, whether it be by hand or with a rope or cable. The trailing skirt extension 132 may also have pivot brackets 166 extending along a length of the trailing skirt extension 132 that are joined together with a turn buckle 168. The pivot brackets 166 enable the turn buckle 168 to provide slight adjustments to the shape of the trailing skirt extension 132 by providing the turn buckle 168 with a manner of grasping the trailing skirt extension 132 at desired points. The turn buckle 168 can then be tightened or released to stiffen the trailing skirt extension 132 in the desired direction.

Many other embodiments of the sled are possible and contemplated, such as the sled 200 shown in FIG. 19. As shown, in some embodiments, flood lights 170 may be included on the front of the sled 200 to provide light during operation. In some embodiments, including in sled 200, the plurality of guiding wheels 152 may be omitted and the arch mandrel 146 may instead be sloped inward to provide the same effect of gradually forcing the forms 108 into the desired position.

Many additional implementations are possible. Further implementations are within the CLAIMS.

It will be understood that implementations of the concrete arch sled include but are not limited to the specific components disclosed herein, as virtually any components consistent with the intended operation of various concrete arch sleds may be utilized. Accordingly, for example, it should be understood that, while the drawings and accompanying text show and describe particular concrete arch sled implementations, any such implementation may comprise any shape, size, style, type, model, version, class, grade, measurement, concentration, material, weight, quantity, and/or the like consistent with the intended operation of concrete arch sleds.

The concepts disclosed herein are not limited to the specific concrete arch sled shown herein. For example, it is specifically contemplated that the components included in particular concrete arch sleds may be formed of any of many different types of materials or combinations that can readily be formed into shaped objects and that are consistent with the intended operation of the concrete arch sled. For example, the components may be formed of: rubbers (synthetic and/or natural) and/or other like materials; glasses (such as fiberglass), carbon-fiber, aramid-fiber, any combination therefore, and/or other like materials; elastomers and/or other like materials; polymers such as thermoplastics (such as ABS, fluoropolymers, polyacetal, polyamide, polycarbonate, polyethylene, polysulfone, and/or the like, thermosets (such as epoxy, phenolic resin, polyimide, polyurethane, and/or the like), and/or other like materials; plastics and/or other like materials; composites and/or other like materials; metals, such as zinc, magnesium, titanium, copper, iron, steel, carbon steel, alloy steel, tool steel, stainless steel, spring steel, aluminum, and/or other like materials; and/or any combination of the foregoing.

Furthermore, concrete arch sleds may be manufactured separately and then assembled together, or any or all of the components may be manufactured simultaneously and integrally joined with one another. Manufacture of these components separately or simultaneously, as understood by those of ordinary skill in the art, may involve 3-D printing, extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular concrete arch sled implementations, it should be readily apparent that a number of modifications may be made without departing from the spirit thereof and that these implementations may be applied to other implementations disclosed or undisclosed. The presently disclosed concrete arch sleds are, therefore, to be considered in all respects as illustrative and not restrictive.

We claim:

1. A method for forming an elongated concrete arch, the method comprising:

positioning a sled with a flat bottom surface in an initial position on a ground surface upon which the elongated concrete arch is to be formed, the sled having a central passage formed as a tunnel extending beneath the sled;

positioning a first arched form on the ground surface within a footprint of the sled adjacent to an entrance to the central passage of the sled;

advancing the sled forward to a first position wherein the first arched form is positioned beneath the sled in the central passage;

forming the first arched form into a desired shape with the sled by contacting the first arched form with the sled and forcing the first arched form into the desired shape, wherein forming the first arched form into the desired shape occurs as a result of advancing the sled forward to the first position;

pouring concrete into a hopper having a hopper opening on an upper surface of the sled;

filling space between the first arched form and the sled with concrete received through the hopper opening to form a first arched section of the elongated concrete arch positioned on the ground surface;

positioning a second arched form on the ground surface within a footprint of the sled adjacent to the entrance to the central passage of the sled, wherein the second arched form is aligned with and adjacent to the first arched form;

advancing the sled forward to a second position wherein the second arched form is positioned beneath the sled in the central passage;

forming the second arched form into the desired shape with the sled by contacting the second arched form with the sled and forcing the second arched form into the desired shape, wherein forming the second arched form into the desired shape occurs as a result of advancing the sled forward to the second position;

filling space between the second arched form and the sled with concrete received through the hopper opening to form a second arched section of the elongated concrete arch positioned on the ground surface aligned with and in direct contact with the first arched section;

removing the first arched form from the elongated concrete arch within 60 minutes of filling the space between the first arched form and the sled with concrete; and removing the second arched form from the elongated concrete arch within 60 minutes of filling the space between the second arched form and the sled with concrete.

2. The method of claim 1, wherein the concrete poured into the hopper of the sled has a slump of between 0.5 and 2.0 inches.

3. The method of claim 2, wherein advancing the sled forward from the initial position to the first position and from the first position to the second position occurs at a constant rate of at least 4 inches per minute.

4. The method of claim 1, wherein the elongated concrete arch is configured to receive stormwater and allow the stormwater to absorb into ground beneath the elongated concrete arch.

5. The method of claim 1, wherein filling the space between the first arched form and the sled with concrete and filling the space between the second arched form and the sled with concrete occur while advancing the sled forward from the initial position to the first position and from the first position to the second position.

6. A method for forming an elongated concrete arch, the method comprising:

positioning a sled in an initial position on a ground surface upon which the elongated concrete arch is to be formed, the sled having a central passage formed as a tunnel extending beneath the sled;

positioning a first form on the ground surface within a footprint of the sled adjacent to an entrance to the central passage of the sled;

advancing the sled forward to a first position wherein the first form is positioned beneath the sled;

forming the first form into an arched shape with the sled, wherein forming the first form into the arched shape occurs as a result of advancing the sled forward to the first position;

pouring concrete into the sled;

filling space between the first form and the sled with concrete to form a first arched section of the elongated concrete arch positioned on the ground surface;

positioning a second form on the ground surface within a footprint of the sled adjacent to the entrance to the central passage of the sled, wherein the second form is aligned with and adjacent to the first form;

advancing the sled forward to a second position wherein the second form is positioned beneath the sled;

forming the second form into the arched shape with the sled, wherein forming the second form into the arched shape occurs as a result of advancing the sled forward to the second position; and filling space between the second form and the sled with concrete to form a second arched section of the elongated concrete arch positioned on the ground surface aligned with and in direct contact with the first arched section.

7. The method of claim 6, wherein advancing the sled forward from the initial position to the first position and the second position occurs at a rate of at least 4 inches per minute.

8. The method of claim 6, wherein the elongated concrete arch is configured to receive stormwater and allow the stormwater to absorb into ground beneath the elongated concrete arch.

9. The method of claim 6, wherein filling the space between the first form and the sled with concrete and filling the space between the second form and the sled with concrete occur while advancing the sled forward from the initial position to the first position and from the first position to the second position.

10. The method of claim 6, further comprising removing the first form from the elongated concrete arch within 90 minutes of filling the space between the first form and the sled with concrete.

11. The method of claim 6, wherein the concrete poured into the sled has a slump of between 0.5 and 2.0 inches.

12. The method of claim 6, wherein forming the first form into the desired shape comprises contacting the first form with the sled and forcing the first form into the desired shape.

13. A method for forming an elongated concrete structure, the method comprising:

positioning a sled in an initial position on a ground surface upon which the elongated concrete arch is to be formed, the sled having a central passage formed as a tunnel extending beneath the sled;

positioning a first form on the ground surface adjacent to an entrance to the central passage of the sled;

advancing the sled forward to a first position wherein the first form is positioned beneath the sled;

forming the first form into a desired shape, wherein forming the first form occurs as a result of advancing the sled forward to the first position;

filling space between the first form and the sled with concrete to form a first section of the elongated concrete structure positioned on the ground surface;

positioning a second form on the ground surface adjacent to the entrance to the central passage of the sled, wherein the second form is aligned with and adjacent to the first form;

advancing the sled forward to a second position wherein the second form is positioned beneath the sled; and filling space between the second form and the sled with concrete to form a second section of the elongated concrete structure positioned on the ground surface aligned with and in direct contact with the first section.

14. The method of claim 13, further comprising forming the first form into a desired shape, wherein forming the first form into the desired shape comprises contacting the first form with the sled and forcing the first form into the desired shape.

15. The method of claim 13, wherein the elongated concrete structure is configured to receive stormwater and allow the stormwater to absorb into ground beneath the elongated concrete structure.

16. The method of claim 13, wherein advancing the sled forward from the initial position to the first position and the second position occurs at a rate of at least 4 inches per minute.

17. The method of claim 13, wherein filling the space between the first form and the sled with concrete and filling the space between the second form and the sled with concrete occur while advancing the sled forward from the initial position to the first position and the second position.

18. The method of claim 13, further comprising removing the first form from the elongated concrete structure within 90 minutes of filling the space between the first form and the sled with concrete.

19. The method of claim 13, wherein the concrete poured into the sled has a slump of between 0.5 and 2.0 inches.

20. The method of claim 13, wherein a portion of the ground surface upon which the elongated concrete structure is formed is exposed within the tunnel after the tunnel is formed.

* * * * *